United States Patent [19]

Umphrey

[11] B 3,998,395

[45] Dec. 21, 1976

[54] LOW PROFILE SUMP WITH SUBMERGED TRANSVERSE ROLL CRUSHER

[75] Inventor: Ronald W. Umphrey, Ponca City, Okla.

[73] Assignee: Continental Oil Company, Ponca City, Okla.

[22] Filed: Apr. 22, 1974

[21] Appl. No.: 462,828

[44] Published under the second Trial Voluntary Protest Program on March 9, 1976 as document No. B 462,828.

[52] U.S. Cl. ..... 241/46.11; 241/223; 241/236

[51] Int. Cl.[2] ..... B02C 23/36

[58] Field of Search ..... 241/38, 46 R, 46.02, 241/46.04, 46.06, 46.08, 46.11, 46.15, 46.17, 62, 222, 223, 224, 227, 236, 242, 243

[56] References Cited

UNITED STATES PATENTS

| | | | |
|---|---|---|---|
| 1,079,301 | 11/1913 | Lloyd | 241/236 X |
| 2,280,944 | 4/1942 | Foresman | 241/46 R X |
| 2,781,915 | 2/1957 | Wormser | 241/222 X |
| 3,240,436 | 3/1966 | Mylting | 241/236 X |

*Primary Examiner*—Granville Y. Custer, Jr.
*Attorney, Agent, or Firm*—William J. Miller

[57] ABSTRACT

A hopper assembly is combined with a two-roll crusher unit to form a combination which not only mixes the product with the fluid but also crushes the product slurry prior to its entry into the pump. The combination essentially comprises a hopper formed by constructing an open-top tank having horizontal dimensions which are greater than the vertical dimensions and having interconnected walls and sidewalls and a bottom tapered downwardly toward one end wall. Water is fed into the tank adjacent the higher end of the bottom. The granular solids are fed into the tank from the top adjacent the higher end of the bottom. A plurality of partitions is placed across the tank extending down into the water to limit the flow of water in the upper portion of the tank, thereby minimizing wave action. Water level sensors are also mounted in the tank to maintain the water at a predetermined level in the tank. The crusher unit consists of two rolls, each having a plurality of spaced peripheral teeth. The rolls are journaled across the opening which is formed in the lower end of the tank. The rolls are journaled and motor driven so that material flowing between the rolls will be moved in the direction of the outlet.

4 Claims, 3 Drawing Figures

LOW PROFILE SUMP WITH SUBMERGED TRANSVERSE ROLL CRUSHER

BRIEF DESCRIPTION OF THE PRIOR ART

A patent entitled "Slurry Hopper System" by David L. McCain, No. 3,845,990 issued Nov. 5, 1974, discloses a slurry hopper which essentially consists of a shallow box having a plurality of partitions to control the flow of water at the surface. A water inlet provides a constant flow of water through the hopper system to convey the product dropped into the hopper out the outlet of the hopper system and into the pump inlet. One of the problems with the hopper as described above is that the coal must be properly sized before it is dropped into the hopper assembly. The proper sizing requires a crusher unit mounted separate from the hopper and also requires a conveyor to feed into the crusher and a conveyor to feed from the crusher into the hopper. In mines, on many occasions, space may be severely limited and such additional apparatus might be difficult to insert into the mine and be moved along with the hopper assembly as needed. Also, such a crushing unit generates dust and noise since it is exposed to the environment.

BRIEF DESCRIPTION OF THE INVENTION

This invention discloses a two-roll crusher unit positioned in a slurry hopper as above described where the rolls are below the surface of the water and in line with the opening to the pump. As the material flows into the hopper and mixes with the water and is propelled along the bottom by the force of the water entering the hopper, the material is moved between the rotating teeth of the crusher unit. As the material flows between the teeth, the unit sizes the product and propels it into the pump opening. Thus, the crusher unit not only operates under water, thereby minimizing dust and noise, but it also provides an additional propellant force for the material out of the hopper unit, thereby better controlling the flow through the hopper and increasing its throughput. The crusher elements are also journaled so as to minimize the height of the crusher unit.

DETAILED DESCRIPTION OF THE FIGURES

The same numbers will be used throughout the specification for the same or similar parts.

Figure 1:
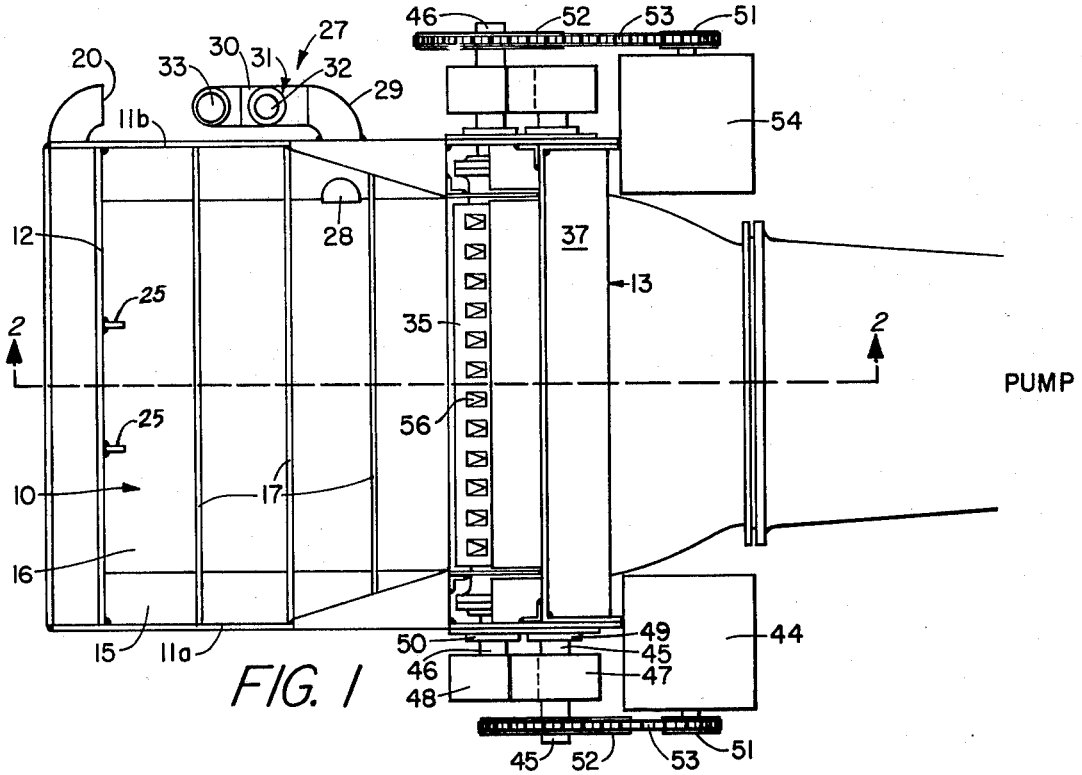
FIG. 1 is a top view of the hopper and crusher unit combination.
Figure 2:
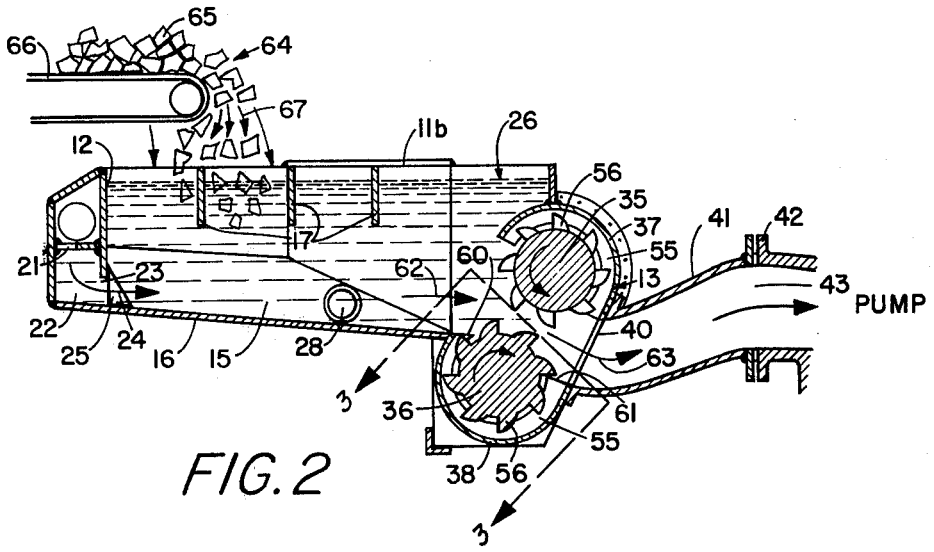
FIG. 2 is a cross-sectional view of the apparatus illustrated in FIG. 1 taken through the lines 2—2; and, FIG. 3 is a sectional view taken through lines 3—3 of FIG. 2.

Referring in particular to FIGS. 1 and 2, a slurry hopper generally referred to by the numeral 10 comprises sidewalls 11A, and 11B, a shallow end wall 12, and a deep end wall 13. The bottom is formed by tapered sidewall 15 and a sloping bottom 16. A plurality of baffles 17 are spaced between sidewalls 11A and 11B and have a sufficient depth to extend below the normal operating water level of the hopper. A water inlet 20 is mounted at the shallow end wall 12 and has an opening 21 (See FIG. 2) which permits the water to flow into channel 22 and out slot 23 in the direction of arrow 24. Triangular wedges 25 provide structural strength for end wall 12. A water level measuring assembly referred to by arrow 27 is mounted in an opening 28 and essentially consists of an elbow 29 mounted to opening 28. A "T" 30 is mounted to the end of elbow 29 which has a short vertically extending center portion 31. Into short vertically extending section 31 is mounted a water sensing unit 32. A second vertically extending section 33 is mounted to "T" 30 and extends above the water line. The water level sensing apparatus 27 is the subject matter of another application and is not a part of this application. Said application is entitled Mounting Apparatus, by William T. Sweeney, filed Mar. 25, 1974, Ser. No. 454,043, and is copending with this application. On the lower end 13 of sump 10 are journaled two crusher rolls 35 and 36, respectively. Each of the rolls has a cylindrically configured cover 37 and 38, respectively, which extends the length of the rolls and attaches to end wall 13. A pump opening 40 is axially aligned with the space between rolls 35 and 36 and communicates with a pipe 41 which is mounted by means of a flange 42 to pump inlet 43.

Referring specifically to FIG. 1, it can be seen that each of the rolls 35 and 36 is journaled through a shaft 45 and 46, respectively, in bearings 47 and 48, respectively. Seals 49 and 50, respectively, provide means for preventing the fluid inside the hopper from escaping. A motor 44 through a drive output such as a sprocket 51 is coupled to a second sprocket 52 by means of a chain 53. Sprocket 52 is axially attached to shaft 45. A second motor 54 is correspondingly attached through drive sprocket 51 to a second sprocket 52 by means of a chain 53 to shaft 46 which is axially attached to sprocket 52. While a motor in general is illustrated, it is obvious that a hydraulic or electric motor can be used, or that a single motor may be coupled to shafts 45 and 46 through belts, chain, or gearbox (direct or indirect) for unsynchronized rotation of rolls 35 or 36. In order for the rolls 35 and 36 to be rotated in synchronism, a positive drive such as gears or chain would ordinarily be used between the shafts 45 and 46.

Figure 3:
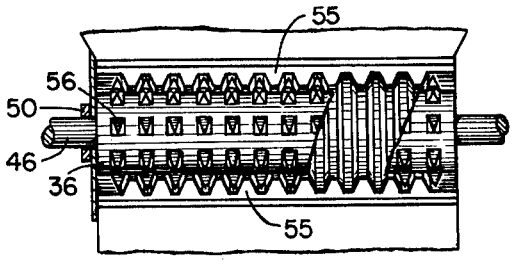

Referring to FIGS. 2 and 3, the layout of cooperating set of grooved elements or stationary teeth can be best illustrated. A plurality of grooved elements or teeth 55 which has a contoured surface conforming to the path generated by rotating teeth 56 is generally in the form of a semi-circle and mounted to covers 37 and 38 which form part of end wall 13. Teeth 55 are positioned between rotating teeth 56 which are attached to the periphery of rolls 35 or 36. Both rolls 35 and 36 have a cooperating set of grooved elements or stationary teeth 55. It should also be noted that the teeth 56 under these conditions must be in line; that is, falling on the same plane taken normal to the axis of rotation of the rolls. The teeth 56 on roll 35 must fit between the teeth 56 on roll 36. It is, of course, obvious that if the rolls are directly synchronized that the teeth can intermesh. Under these conditions, rather than eight teeth being mounted around the periphery as illustrated in the drawings, four teeth would be mounted around the periphery in any one plane with twice as many circumferential rows of teeth per roll. The ends 60 and 61 of grooved elements 55 are designed to be flush with the bottom 16 and bottom of pipe 41 so that the material can flow directly along with bottom 16 and into the spacing between rolls 35 and 36 in the manner as illustrated by arrows 62 and 63. In normal use, a conveyor, generally referred to by the arrow 64, would be mounted over sump 10 in a manner so that product 65 on belt 66 would move and fall in the direction of arrows 67 into the sump.

Operation

The operation of the crusher sump is in the following manner. Water through water inlet 20 enters opening 21, into channel 22, and out slot 23 in the direction of arrow 24 filling sump 10 to the water line generally indicated by arrow 26. The amount of water entering this sump is extremely high in gallons per minute; therefore, in order to cut down the wave action, the baffles 17 are added along the top of the water line to slow down the movement of water along this surface, thereby reducing the wave action at the water line. The water level is continuously monitored by water entering opening 28 and up vertical extension 31 to water level sensing means 32 which may be of any usual type. Water level sensor 32 will control a valve (not shown) which controls the amount of water entering pipe 20. Product moving along conveyor 64 on belt 66 will drop into the hopper and be forced along its bottom by the velocity of the water entering through slot 23 in the general direction of arrow 24.

Motors 44 and 54 are energized, rotating sprockets 51, driving sprockets 52 through chains 53, thereby turning respectively shafts 45 and 46. Rotation of these shafts will cause rotation of the rolls in the general direction of the arrows shown in FIG. 2. As the rolls rotate, the product moving along the bottom as a consequence of the movement of the water, will move between the teeth 56 of each of the crusher rolls 35 and 36 where the product will be crushed to a predetermined size and forced in the direction of arrow 63 into the pump inlet 43. Product continuing around the roll will be minimized by stationary teeth 55. As a consequence, the product through the movement of the water and the other product in the line will travel along arrow 63. Both rolls 35 and 36 have the stationary teeth 55, thereby limiting the product from following around the roll behind the roll causing jamming or other mechanical problems. The entrance to the crusher formed by teeth 55 at end 60 also provides a natural inlet ramp to the crusher unit. It can be seen upon viewing the operation that the crusher unit not only sizes the material but also coacts with the movement of the water out of slot 23 and the movement of the water due to the pump by propelling the product in the direction of the pump. Thus, not only do the rolls create a sizing of the coal but also create a movement of the product into the inlet of the pump. The top roll 35 is under the water line 26 of sump 10 in order to minimize the formation of dust and noise. However, it is obvious that the crusher unit would operate effectively whether roll 35 was completely submerged or not. It should also be noted that the axial positioning of the rolls is such that the rolls in combination with the sump will have a minimum height.

Conclusions

A combination sump and crusher has been disclosed. Not only will the sump and crusher combination operate with less dust and noise than previous prior art systems, but the crusher unit coacts to force the product through the sump and into the pump inlet. It is obvious, of course, that other configurations of crusher units can be incorporated. For example, instead of two rolls, four rolls could be incorporated or different teeth configurations can be used depending upon whether the rolls are individually driven as illustrated or whether they are geared together in synchronism as described in the specification. It is obvious, of course, that any sump configuration can be used in combination with the crushers. The invention lies with the combination of the crusher unit positioned in front of the pump inlet so that the product can be propelled into the pump as a prepared and sized product.

It is understood that the present invention is, by no means, limited to the specific apparatus described but also contemplates changes and modifications within the scope of the appended claims.

I claim:

1. In combination with a hopper assembly for forming a slurry of a granular solid product in water in restricted spaces for transportation by a slurry pump having an open-top tank with horizontal dimensions greater than vertical dimensions and having interconnected end walls and side walls and a bottom tapered downwardly toward one end wall; means for feeding water into the tank adjacent the higher end of the bottom; means for feeding the granular solid into the tank adjacent the higher end of the bottom; means adjacent the lower end of the tank bottom forming an outlet for the slurry to the pump; means in the tank limiting the flow of water through the upper portion of the tank to minimize wave action; and means for maintaining the water at a predetermined level in the tank; a crushing apparatus comprising a. first and second cylindrical rolls each having a plurality of spaced peripheral teeth;

b. means for axially journaling said first and second cylindrical rolls in said outlet for the slurry pump; and c. means for axially rotating said rolls to move substantially all of said product and water between said rolls and from said tank to said pump.

2. A combination as defined in claim 1 wherein said crushing unit has a plurality of semi-cylindrical stationary teeth extending between said plurality of spaced peripheral teeth of both said rolls and each said stationary teeth mounted in said outlet facing said rolls.

3. A combination as defined in claim 2 wherein said first and second cylindrical rolls are horizontally journaled with said first roll positioned above said second roll, a first cylindrical portion of said outlet mounted above said first roll and a second cylindrical portion of said outlet mounted below said second roll and each having a diameter greater than the diameter of a circle generated by the tip of said peripheral teeth mounted on said rolls, and means for mounting said stationary teeth on said cylindrical portions.

4. A combination as defined in claim 1 wherein said first and second rolls are horizontally journaled in the side walls of said slurry hopper with the space between said first and second rolls aligned with the axis of said outlet and with the bottom of said hopper assembly.

* * * * *